US012472418B2

(12) United States Patent
Kim

(10) Patent No.: US 12,472,418 B2
(45) Date of Patent: Nov. 18, 2025

(54) HEIGHT-ADJUSTABLE GOLF PRACTICE APPARATUS

(71) Applicant: Young Ha Kim, Palisades, NJ (US)

(72) Inventor: Young Ha Kim, Palisades, NJ (US)

( * ) Notice: Subject to any disclaimer, the term of this patent is extended or adjusted under 35 U.S.C. 154(b) by 294 days.

(21) Appl. No.: 18/241,379

(22) Filed: Sep. 1, 2023

(65) Prior Publication Data

US 2024/0238661 A1 Jul. 18, 2024

Related U.S. Application Data

(63) Continuation of application No. PCT/KR2022/003028, filed on Mar. 3, 2022.

(30) Foreign Application Priority Data

Mar. 3, 2021 (KR) ..... 10-2021-0028280

(51) Int. Cl.
*A63B 69/36* (2006.01)

(52) U.S. Cl.
CPC ..... *A63B 69/3661* (2013.01)

(58) Field of Classification Search
CPC . A63B 69/3661; A63B 24/00; A63B 57/0006; A63B 67/02; A63B 69/36; A63B 24/0087; A63B 2067/025; A63B 2225/093
USPC ..... 473/160–163, 157, 278, 279
See application file for complete search history.

(56) References Cited

U.S. PATENT DOCUMENTS

| | | | | | |
|---|---|---|---|---|---|
| 1,612,291 | A * | 12/1926 | Jackson | A63B 67/02 | 14/71.1 |
| 3,690,673 | A * | 9/1972 | Occhipinti | A63B 67/02 | 473/160 |
| 5,655,971 | A * | 8/1997 | Wayne | A63B 67/02 | 473/279 |
| 6,056,645 | A * | 5/2000 | Servatius | A63B 67/02 | 473/162 |
| 6,338,682 | B1 * | 1/2002 | Torchia | A63B 67/02 | 473/160 |
| 10,486,047 | B2 * | 11/2019 | Coffman | A63B 69/3661 | |
| 2004/0137995 | A1 * | 7/2004 | Chang | A63B 67/02 | 473/163 |
| 2007/0237583 | A1 * | 10/2007 | Corwon | E01C 13/02 | 405/37 |
| 2014/0073445 | A1 * | 3/2014 | Flammer | A63B 69/3676 | 473/409 |

FOREIGN PATENT DOCUMENTS

| | | | |
|---|---|---|---|
| KR | 1020050025031 | A | 3/2005 |
| KR | 1020110066487 | A | 6/2011 |

* cited by examiner

*Primary Examiner* — Nini F Legesse
(74) *Attorney, Agent, or Firm* — Dinsmore & Shohl LLP; Yongsok Choi, Esq.

(57) ABSTRACT

Disclosed is a golf practice apparatus. The golf practice apparatus includes a body part having, at the upper side thereof, a hole-cup hole into which a golf ball goes; and a lifting/lowering part which is connected to the lower side of the body part and which moves at least a portion of a region of the body part in the vertical direction, wherein the lifting/lowering part includes: a plurality of lifting/lowering units for pushing or pulling a portion of the region of the body part; and a driving unit for driving each of the lifting/lowering units.

4 Claims, 9 Drawing Sheets

HEIGHT-ADJUSTABLE GOLF PRACTICE APPARATUS

CROSS-REFERENCE TO RELATED APPLICATIONS

This application is a continuation of International Application No. PCT/KR2022/003028 filed on Mar. 3, 2022, which claims priority to Korean Patent Application No. 10-2021-0028280 filed on Mar. 3, 2021, the entire contents of which are herein incorporated by reference.

TECHNICAL FIELD

The present disclosure relates to a height-adjustable golf practice apparatus, and more specifically, to a height-adjustable golf practice apparatus capable of implementing the shape of a real field by using a lifting/lowering portion.

BACKGROUND ART

Generally, because golfers have distance and time constraints to find a golf course to practice putting, they visit a golf driving range. A golf practice apparatus of a golf driving range which is an indoor golf apparatus is mainly divided into screen golf, which displays various terrains or environments of an actual golf course on the screen for practice, and a putting practice apparatus, which puts a golf ball into a hole-cup.

Among these, putting, which rolls and puts a golf ball on a green with a hole-cup by using a putter, occupies an important part of golf, and is usually fixed so as to be practiced only on a flat or sloped surface, or is configured as a practice apparatus capable of implementing only the slope of a terrain. Because the slope and curvature of the green cannot be finely controlled, there are limits for users to feel experience of the real field through a golf practice apparatus.

DISCLOSURE

Technical Problem

It is an object of the present disclosure to solve all the problems mentioned above.

It is another object of the present disclosure to provide a golf practice apparatus capable of controlling the height and curvature thereof and implementing a real field, thereby helping improve golf skills.

Technical Solution

In order to achieve the purpose of the present disclosure as described above and implement the characteristic effects of the present disclosure described below, the characteristic configuration of the present disclosure is as follows.

According to one aspect of the present disclosure, there is provided a golf practice apparatus including a body portion comprising a hole-cup hole, into which a golf ball goes, formed at an upper side thereof, and a lifting/lowering portion connected to a lower side of the body portion and configured to move at least a partial area of the body portion in a vertical direction, wherein the lifting/lowering portion includes a plurality of lifting/lowering units configured to push or pull a partial area of the body portion, and a driving unit configured to drive each of the plurality of lifting/lowering units.

Advantageous Effects

According to the present disclosure, the following effects are achieved.

The present disclosure has the effect of enabling practice in an environment similar to the real field by adjusting the height of the body portion according to the vertical movement of the lifting/lowering portion and implementing the real field.

MODE FOR DISCLOSURE

Figure 1:
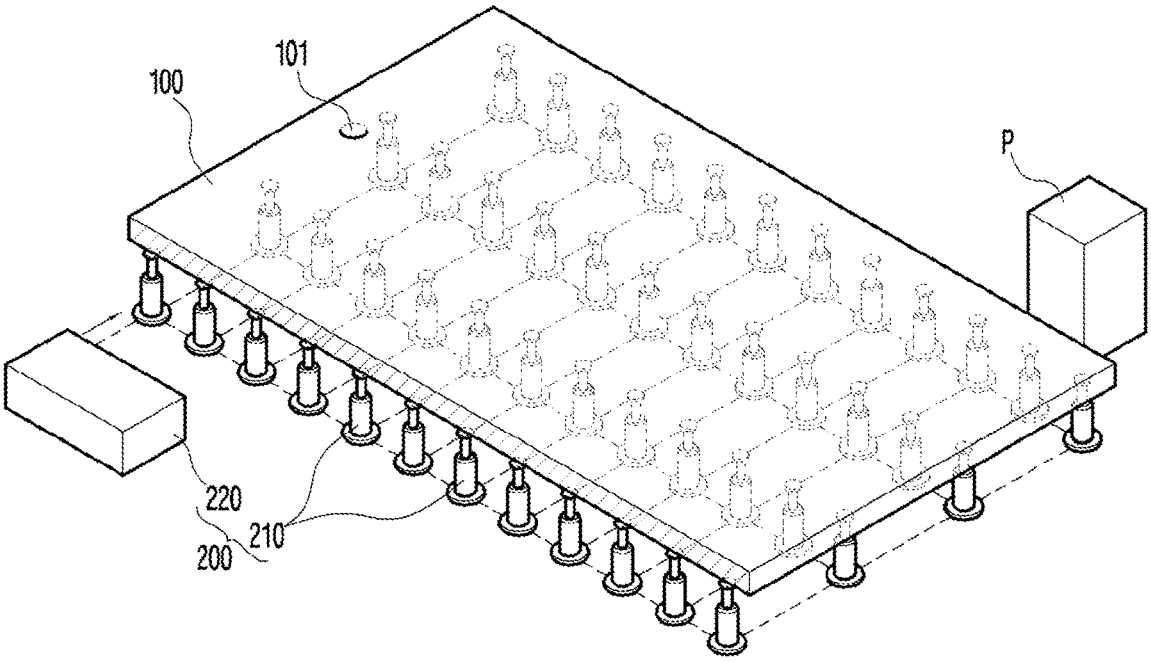
FIG. 1 is a partial exploded perspective view for explaining a golf practice apparatus according to an embodiment of the present disclosure.

The detailed description of the present disclosure illustrates specific embodiments in which the present disclosure may be performed by reference to the attached drawings. These embodiments are described in sufficient detail to enable those skilled in the art to practice the invention. It is to be understood that the various embodiments of the present disclosure, although different from each other, are not necessarily mutually exclusive. For example, a particular feature, structure, or characteristic described herein in connection with an embodiment may be implemented within other embodiments without departing from the spirit and scope of the present disclosure. In addition, it is to be understood that the location or arrangement of individual elements within each disclosed embodiment may be modified without departing from the spirit and scope of the present disclosure. The following detailed description is, therefore, not to be taken in a limiting sense, and the scope of the present disclosure is defined only by the appended claims, appropriately interpreted, along with the full range of equivalents to which the claims are entitled. In the drawings, like numerals refer to the same or similar functionality throughout the several views.

Hereinafter, in order to enable those skilled in the art to easily practice the present disclosure, preferred embodiments of the present disclosure will be described in detail with reference to the attached drawings.

Figure 2:
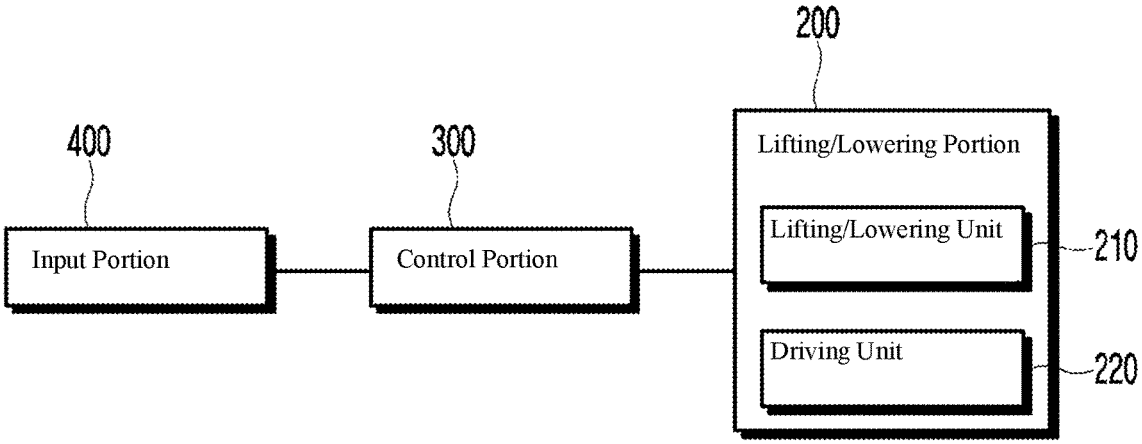
FIG. 2 is a block diagram for explaining an operation of a control portion of the golf practice apparatus according to an embodiment of the present disclosure.
Figure 3:
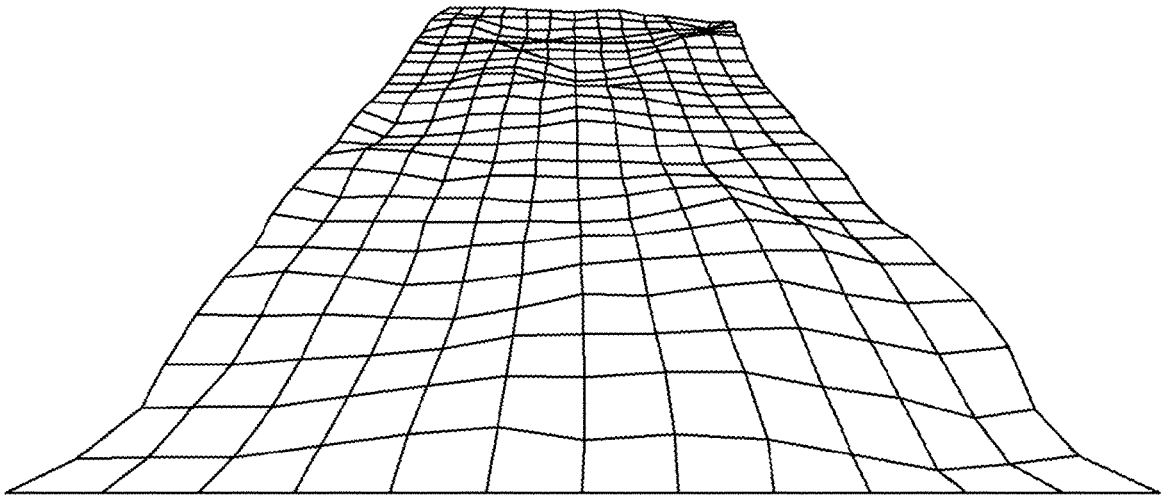
FIG. 3 is an exemplary diagram illustrating ground information of a field according to an embodiment.
Figure 4:
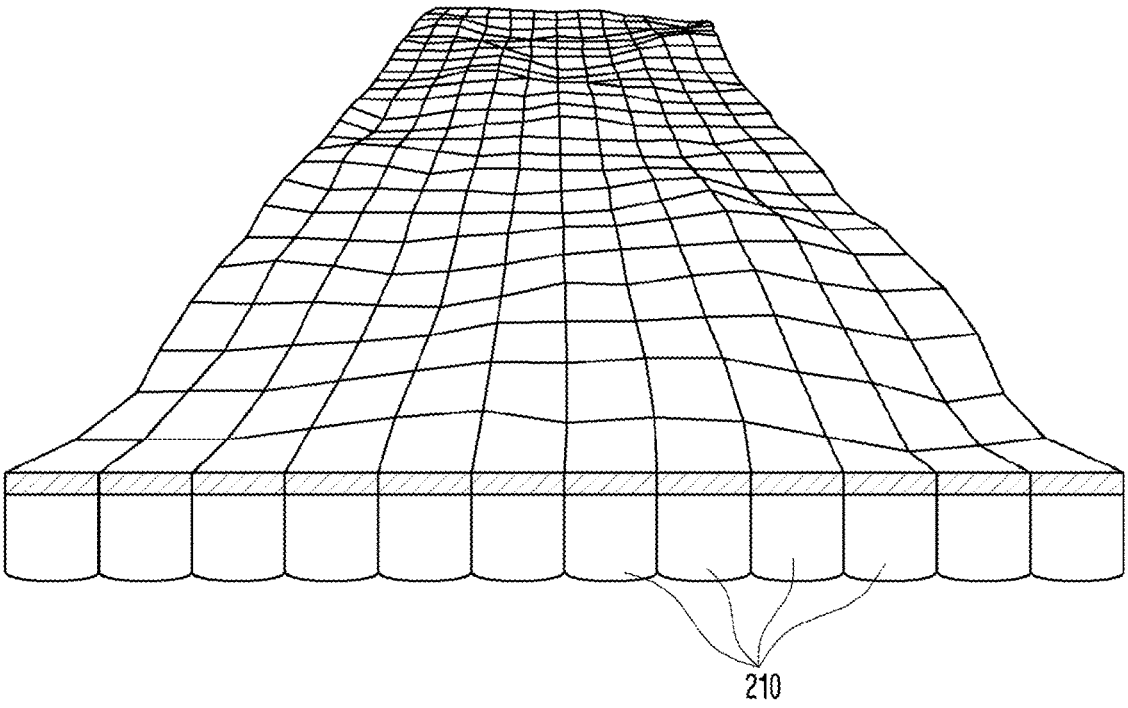
FIG. 4 is an exemplary diagram illustrating operations of lifting/lowering units according to an embodiment.

FIG. 1 is a partial exploded perspective view for explaining a golf practice apparatus 1 according to an embodiment of the present disclosure. FIG. 2 is a block diagram for explaining an operation of a control portion 300 of the golf practice apparatus 1 according to an embodiment of the present disclosure. FIG. 3 is an exemplary diagram illustrating ground information of a field according to an embodiment. FIG. 4 is an exemplary diagram illustrating operations of lifting/lowering units 210 according to an embodiment.

Referring to FIGS. 1 and 2, the golf practice apparatus 1 according to an embodiment of the present disclosure may include a body portion 100, a lifting/lowering portion 200, and the control portion 300. In addition, the golf practice apparatus 1 may further include a putting portion (not shown).

Hereinafter, the components are sequentially described.

The body portion 100 may include a hole-cup hole 101 into which a golf ball B goes at an upper side thereof. In addition, the upper side of the body portion 100 may include artificial grass or natural grass. The body portion 100 may be made of an elastic rubber or silicone material that may be stretched according to a vertical movement of the lifting/lowering portion 200, which will be described below, but is not limited thereto.

The lifting/lowering portion 200 may be connected to a lower side of the body portion 100 and may move a partial area of the body portion 100 in a vertical direction. The lifting/lowering portion 200 may include a plurality of lifting/lowering units 210 capable of pushing or pulling the partial area of the body portion 100 and a plurality of driving units 220 capable of driving the lifting/lowering units 210.

The lifting/lowering units 210 may be arranged in a plurality of columns and rows based on the size of the body portion 100. For example, the lifting/lowering units 210 may be arranged in columns and rows in the shape of 12 (horizontal)×4 (vertical) in the body portion 100 which is horizontally long, and the lifting/lowering units 210 may be arranged in columns and rows in the form of 4 (horizontal)×12 (vertical) in the body portion 100 which is vertically long.

In an embodiment, the lifting/lowering units 210 may be hydraulic cylinders. Alternatively, in another embodiment, the lifting/lowering units 210 may be air cells, pneumatic cylinders, etc., and any units capable of lifting/lowering have no limitation.

In an embodiment, the driving units 220 may each include a hydraulic pump supplying a hydraulic pressure to a hydraulic cylinder. The hydraulic pump may be controlled through the control portion 300, which will be described below, to cause a vertical movement of the hydraulic cylinder. Alternatively, in another embodiment, the driving units 220 may be air pumps that inject and remove air, and any units causing operations of the lifting/lowering units 210 have no limitation.

The control portion 300 may receive ground information of a field and control the driving units 220 so that the body portion 100 corresponds to the ground information.

A control panel P including the control portion 300 may be attached to one end of the body portion 100 or installed on the outside of the body portion 100. When the control panel P is attached to the body portion 100, the body portion 100 may further include a support frame capable of supporting the control portion 300. A process in which the control portion 300 controls the driving units 220 by using the field information will be described below with reference to FIG. 6.

In addition, the control panel P may include an input portion 400 through which a user may input the ground information of the field to be used. Any apparatus capable of inputting information to the control panel P through a keyboard, a mouse, a touchpad, sound, etc. may be adopted as the input portion 400 according to the present disclosure.

Referring to FIGS. 3 and 4, the control portion 300 of the golf practice apparatus 1 may receive the information about the ground of the field through the input portion 400 as shown in FIG. 3. The ground information of the field that users will use may use not only graphical ground information of various fields across the country such as Korea's 88 cc and 123 gc and overseas various fields such as Banff Spring Golf Course in Canada, Ulm Golf Course in Germany, Pebble Beach Golf Course in San Francisco of the U.S., etc., but also real graphical ground information of green which is difficult even for world-class players such as KLPGA, KPGA, LPGA, PGA, and European Tour. The ground information is described in computer graphic form in the present specification, but is not limited thereto, and the golf practice apparatus 1 may implement various high-level shots and putts by allowing the user to input a virtual field value through the input portion 400.

At this time, based on the ground information in graphic form, the control portion 300 may implement the golf practice apparatus 1 similar to a real field by adjusting heights of the lifting/lowering units 210 as shown in FIG. 4. Controlling the heights of the lifting/lowering units 210 will be described in detail with reference to FIG. 6.

The putting portion may be located adjacent to one side of the body portion 100. A golfer may stand on the putting portion and putt a golf ball toward the hole-cup hole 101 of the body portion 100. In addition, the position of the hole-cup hole 101 may be set by the user.

Figure 5:
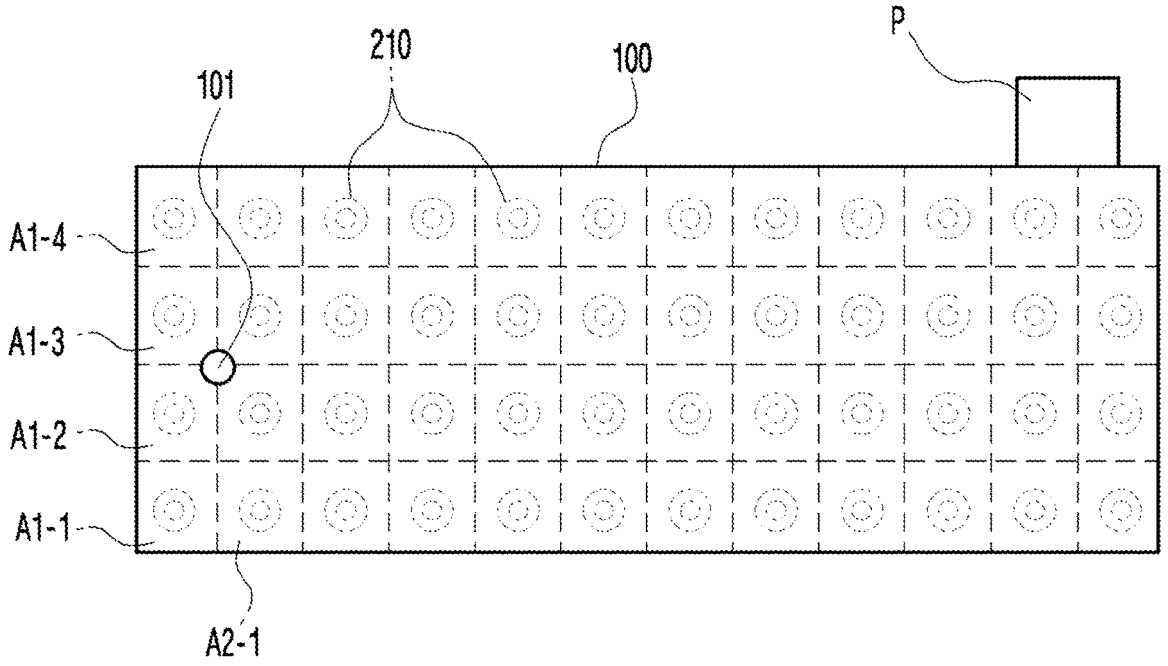
FIG. 5 is a plan view for explaining a golf practice apparatus according to an embodiment of the present disclosure.

FIG. 5 is a plan view of the golf practice apparatus 1 according to an embodiment of the present disclosure.

Referring to FIG. 5, the body portion 100 may be partitioned based on columns and rows of the lifting/lowering units 210. Partitioned areas of the body portion 100 may overlap with any one of the lifting/lowering units 210. In an embodiment, the partitioned areas may be virtually partitioned areas rather than physically partitioned areas. Alternatively, in another embodiment, the partitioned areas may be physically partitioned areas.

For example, when the lifting/lowering units 210 are arranged in the shape of 12 (horizontal)×4 (vertical), the body portion 100 may be partitioned into areas of 12 (horizontal)×4 (vertical). The partitioned areas of the body portion 100 may be expressed as A1-1, A1-2, etc. The A1-1 area may include a 1-1 lifting/lowering unit 210 located within the A1-1 area. The A1-2 area may include a 1-2 lifting/lowering unit 210 located within the A1-2 area. Accordingly, the A1-1 area and the 1-1 lifting/lowering unit 210 may overlap vertically, and the A1-2 area and the 1-2 lifting/lowering unit 210 may overlap vertically.

At this time, the quantity and arrangement of the lifting/lowering units 210 may be changed not only through the columns and rows of the lifting/lowering units 210, but also through user settings. The partitioned areas may also be changed based on the user settings.

Figure 6A:
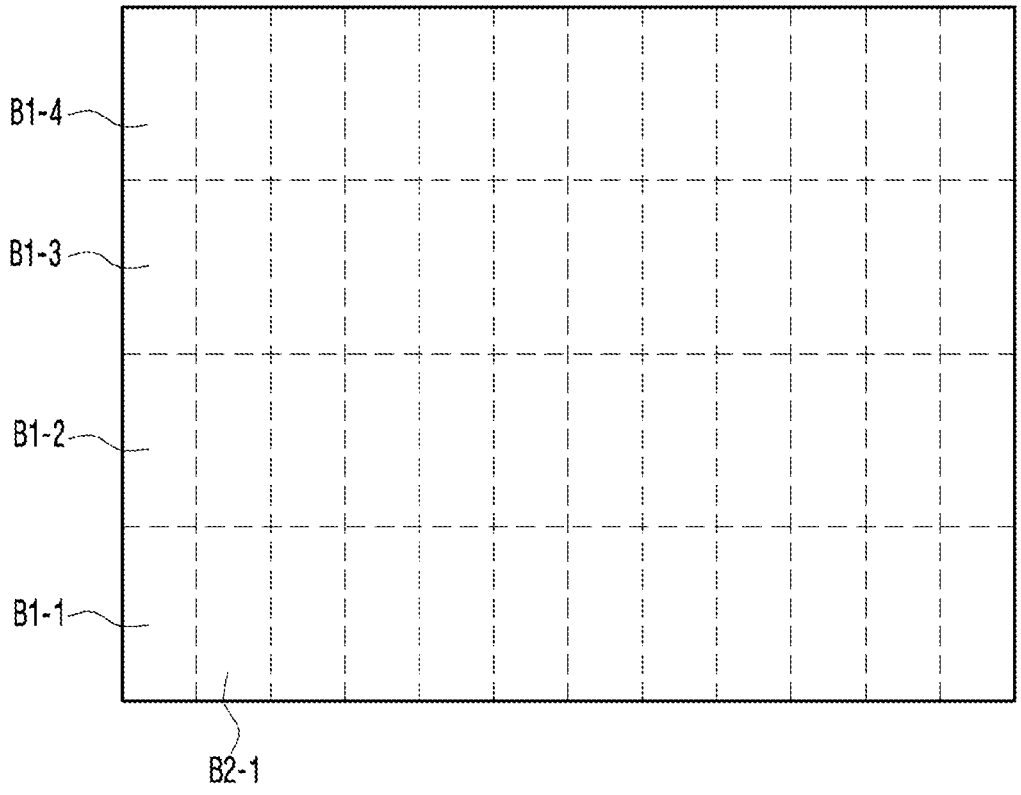
FIGS. 6A and 6B are diagrams for explaining field ground information according to an embodiment.
Figure 6B:
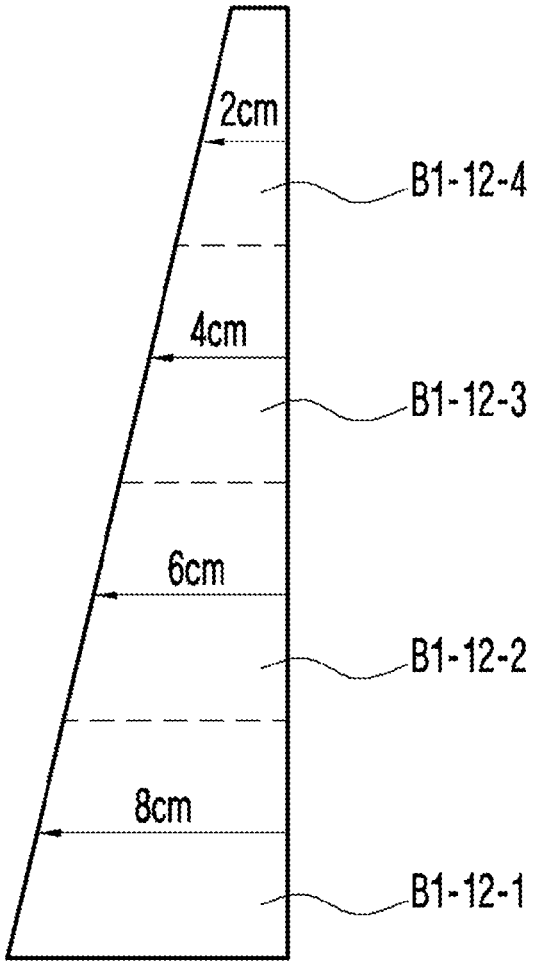

FIG. 6A is a top view of the field according to an embodiment, and FIG. 6B is a front view of the field according to an embodiment.

Referring to FIGS. 6A and 6B, the control portion 300 may store ground information of the field input through the input portion 400. At this time, the ground information may be information about a ground of the field corresponding to an upper side of the body portion 100.

In addition, the ground information may include a plurality of pieces of partition information of the ground partitioned based on the columns and rows of the lifting/lowering units 210. The plurality of pieces of partition information may respectively correspond to the partitioned areas of the body portion 100.

Each of the plurality of pieces of partition information may include height information of the partitioned ground. The control portion 300 may match the ground information input through the input portion 400 with the partitioned areas of the body portion 100.

For example, when the lifting/lowering units 210 are arranged in the shape of 12 (horizontal)×4 (vertical), the body portion 100 may be partitioned into 12 (horizontal)×4 (vertical). The partitioned areas of the body portion 100 may be expressed as A1-1, A1-2, etc. The control portion 300 may obtain partition information of the ground partitioned into 12 (width)×4 (length). Partitioned areas of the ground may be expressed as B1-1, B1-2, etc. The partition information may include 1-1 partition information matching the B1-1 area and 1-2 partition information matching the B1-2 area. The 1-1 partition information may include 1-1 height information, which is height information with respect to the ground in the B1-1 area, and the 1-2 partition information may include 1-2 height information, which is height information with respect to the ground in the B1-2 area. The control portion 300 may match the A1-1 area in which the body portion 100 is partitioned with the B1-1 area in which the ground is partitioned, and may match the A1-2 area with the B1-2 area. The partition information including the height information of ground may be stored in the control portion 300.

Figure 7:
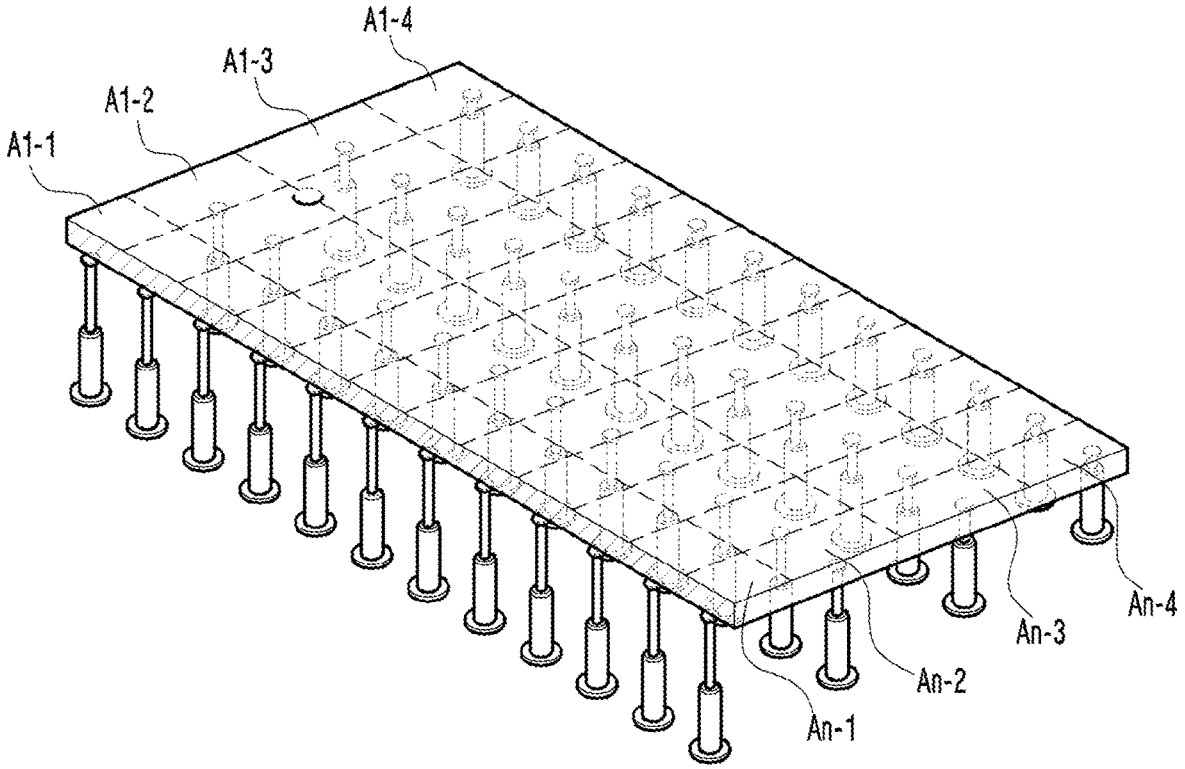
FIG. 7 is a diagram illustrating a movement of a lifting/lowering unit based on partitioned field ground information according to an embodiment.

FIG. 7 is a diagram illustrating a movement of the lifting/lowering units 210 based on a partitioned ground according to an embodiment.

Referring to FIG. 7, the lifting/lowering units 210 may be arranged in the shape of 12 (horizontal)×4 (vertical), and heights of the lifting/lowering units 210 may be adjusted through the control portion 300 based on height information of the partitioned ground.

The control portion 300 may control the driving units 220 to correspond to the height information of the ground. For example, when height values of the lifting/lowering units 210 are greater than the height information of the ground, the control portion 300 may control the driving units 220 so that the lifting/lowering units 210 are lowered. In addition, when the height values of the lifting/lowering units 210 are less than the height information of the ground, the control portion 300 may control the driving units 220 so that the lifting/lowering units 210 are lifted. In other words, the control portion 300 may control the driving units 220 so that the height values of the lifting/lowering units 210 correspond to the height information of the ground. When the height values of the lifting/lowering units 210 correspond to the height information of the ground, the control portion 300 may control the driving units 220 so that the lifting/lowering units 210 are not lifted/lowered. This will be explained in detail with an example below.

In addition, ground information including the height information of the ground may be input to the control portion 300 through the input portion 400. The control portion 300 may calculate an average value of the height information included in the input ground information. Based on the average value of the height information, the control portion 300 may control the driving units 220 to adjust the heights of the lifting/lowering units 210.

For example, when the lifting/lowering units 210 are arranged in the shape of 12 (horizontal)×4 (vertical), the body portion 100 and the ground may be partitioned into 12 (horizontal)×4 (vertical). When the 1-1 height information in the B1-1 area is 8 cm, the 1-2 height information in the B1-2 area is 6 cm, the 1-3 height information in the B1-3 area is 4 cm, and the 1-4 height information in the B1-4 area is 2 cm, the control portion 300 may calculate and store 5 cm, which is the average value of the height information of the ground. The control portion 300 may control the 1-1 driving unit 220 in the A1-1 area matching the B1-1 area on the ground to lift the 1-1 lifting/lowering unit 210 by 3 cm (8 cm-5 cm), which is a difference in the average value between the 1-1 height information and the height information of the ground. The control portion 300 may control the 1-2 driving unit 220 in the A1-2 area matching the B1-2 area on the ground to lift the 1-2 lifting/lowering unit 210 by 1 cm (6 cm-5 cm), which is a difference in the average value between the 1-2 height information and the height information of the ground. The control portion 300 may control the 1-3 driving unit 220 in the A1-3 area matching the B1-3 area on the ground to lower the 1-3 lifting/lowering unit 210 by 1 cm (4 cm-5 cm), which is a difference in the average value between the 1-3 height information and the height information of the ground. The control portion 300 may control the 1-4 driving unit 220 in the A1-4 area matching the B1-4 area on the ground to lower the 1-4 lifting/lowering unit 210 by 3 cm (2 cm-5 cm), which is a difference in the average value between the 1-4 height information and the height information of the ground.

Accordingly, the heights of the lifting/lowering units 210 and the body portion 100 that overlap in the partitioned areas may be adjusted. For convenience of explanation, in the present specification, the average value of the height information is calculated based on height information of areas partitioned in a first column of the ground, but is not limited thereto, and the average value of the height information may be calculated based on the height information of the entire ground or a certain area.

In addition, in the present specification, the height is adjusted in units of a value of 1 cm, but is not limited thereto. In addition, the control portion 300 may variously adjust the heights of the lifting/lowering units 210 from 0.5 cm to 1 m or more based on user settings or ground information of a field.

The control portion 300 may control the driving units 220 based on the height information to adjust the heights of the lifting/lowering units 210. When the height information of the ground exceeds a preset height, the driving units 220 may supply hydraulic pressure to lift the lifting/lowering units 210. In addition, when the height information is less than the preset height, the driving units 220 may remove the hydraulic pressure to lower the lifting/lowering units 210.

Accordingly, the height of the partitioned body portion 100 may be adjusted through lifting and lowering of the lifting/lowering units 210 so that the body portion 100 may form a slope.

For example, as shown in FIG. 5, the lifting/lowering unit 210 is lifted so that the A1-1 area of the body portion 100 may be high, and the lifting/lowering unit 210 is lowered so that the A1-4 area of the body portion 100 may be low. Accordingly, the body portion 100 may form the slope in which the A1-1 area is high and the A1-4 area is low.

Figure 8:
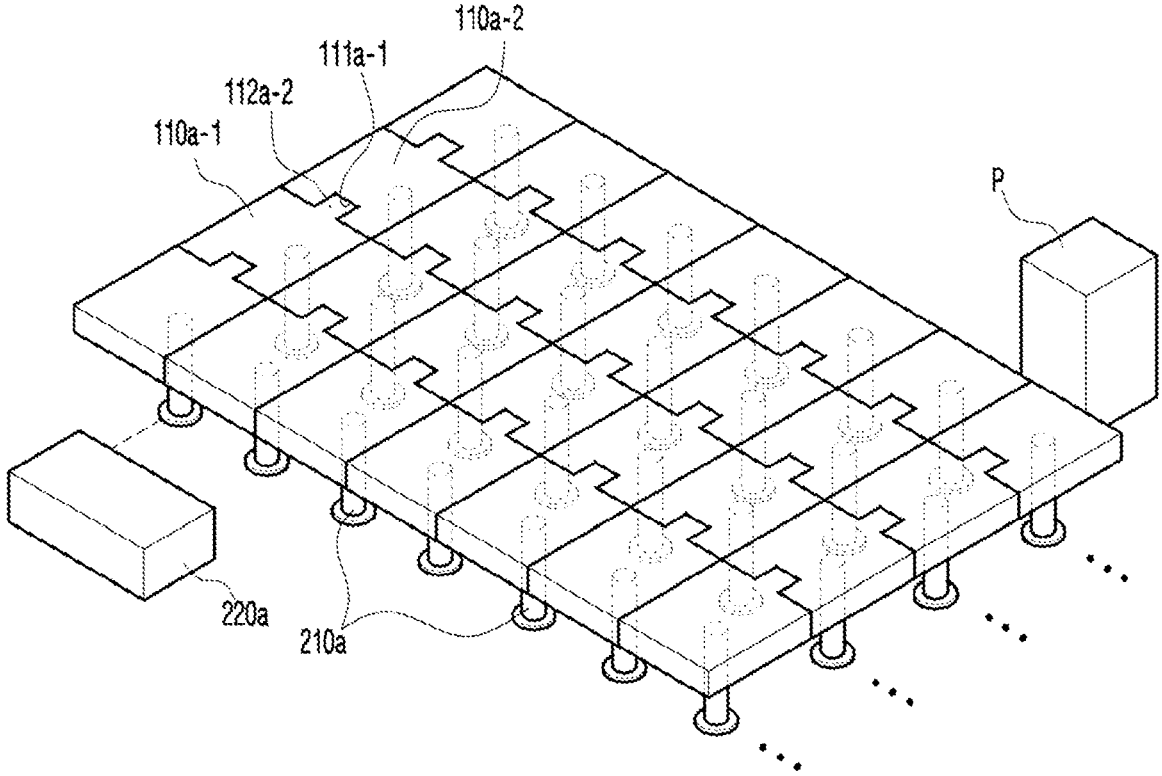
FIG. 8 is a partial exploded perspective view for explaining a golf practice apparatus according to another embodiment of the present disclosure.
Figure 9:
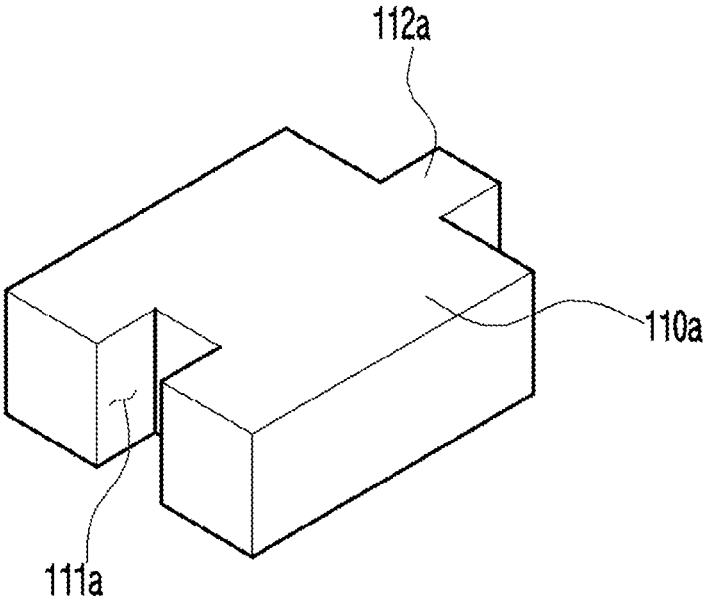
FIG. 9 is a cross-sectional view for explaining a body portion of FIG. 8.

FIG. 8 is a partially exploded perspective view for explaining a golf practice apparatus 1*a* according to another embodiment of the present disclosure, and FIG. 9 is a cross-sectional view for explaining a body portion of FIG. 8. For convenience of explanation, descriptions of the same configurations as those described with reference to FIGS. 1 to 7 are omitted or briefly provided.

Referring to FIGS. 8 and 9, the golf practice apparatus 1*a* according to another embodiment of the present disclosure may include a body portion and a lifting/lowering portion 210*a*.

The body portion may have a different structure from that of the body portion 100 described with reference to FIGS. 1 to 7. The body portion may include a plurality of bodies 110*a* respectively corresponding to lifting/lowering units 210*a* and arranged in a plurality of columns and rows. The plurality of bodies 110*a* may respectively correspond to the lifting/lowering units 210*a*. In addition, the bodies 110*a* may respectively correspond to the above-described partitioned areas. Accordingly, in another embodiment, the partitioned areas may be areas physically partitioned by the bodies 110*a*.

The lifting/lowering units 210*a* may move the bodies 110*a* respectively corresponding thereto in a vertical direction.

When any one of the lifting/lowering units 210*a* moves in a downward direction, the bodies 110*a* respectively corresponding to the lifting/lowering units 210*a* moving in the downward direction may move in the downward direction. When any one of the lifting/lowering units 210*a* moves in an upward direction, the bodies 110*a* respectively corresponding to the lifting/lowering units 210*a* moving in the upward direction may move in the upward direction.

The bodies 110*a* may each include a sliding groove 111*a* and a sliding protrusion 112*a*. The bodies 110*a* may slide in the vertical direction along the sliding grooves 111*a* of the adjacent bodies 110*a*.

When a first body 110*a*-1, which is one of the bodies 110*a*, and a second body 110*a*-2, which is the other one of the bodies 110*a*, are located adjacent to each other, the first body 110*a*-1 may include a sliding groove 111*a*-1 recessed inward on one side adjacent to the second body 110*a*-2, and the second body 110*a*-2 may include a first sliding protrusion 112*a*-2 protruding outward on one side adjacent to the first body 110*a*-1 and inserted into the sliding groove 111*a*-1. At this time, the second body 110*a*-2 may slide in the vertical direction along the sliding groove 111*a*-1 of the first body 110*a*-1.

In another embodiment, the lifting/lowering unit 210*a* may be an air cell. The lifting/lowering unit 210*a* may be a hydraulic cylinder, etc., and any unit capable of lifting/lowering has no limitation.

A driving unit 220*a* may include an air pump that injects and removes air into and from the air cell. The air pump may be controlled through the control portion 300 to cause contraction and expansion movements of the air cell. The height of the body portion may be adjusted through the contraction and expansion movements of the air cell.

The driving unit 220*a* may include the air pump that injects and removes air into and from the air cell. The air pump may be controlled through the control portion 300 to cause contraction and expansion movements of the air cell. The height of the body portion may be adjusted through the contraction and expansion movements of the air cell.

The control portion 300 may control the driving unit 220*a* based on height information to adjust the height of the lifting/lowering unit 210*a*. When the height information of a field exceeds ae preset height, the driving unit 220*a* may inject air so that the lifting/lowering unit 210*a* may be lifted. In addition, when the height information is less than the preset height, the driving unit 220*a* may remove air so that the lifting/lowering unit 210*a* may be lowered.

The plurality of bodies 110*a* may include elastic materials such as silicone rubber on upper surfaces thereof. Although bumps may be generated between the plurality of bodies 110*a* by adjusting heights of the lifting/lowering units 210*a*, elastic materials located on the upper surfaces of the plurality of bodies 110*a* may cover the bumps between the plurality of bodies 110*a* and implement a natural field.

Figure 10:
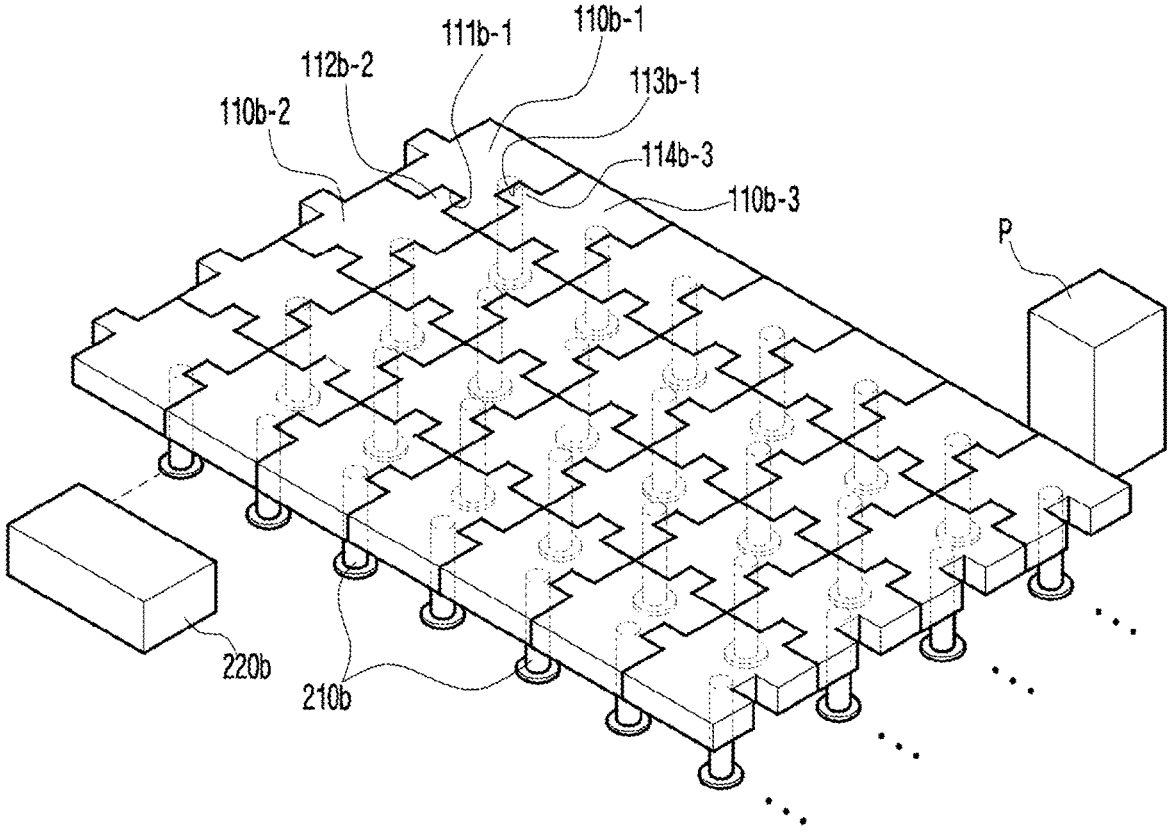
FIG. 10 is a partial exploded perspective view for explaining a golf practice apparatus according to another embodiment of the present disclosure.
Figure 11:
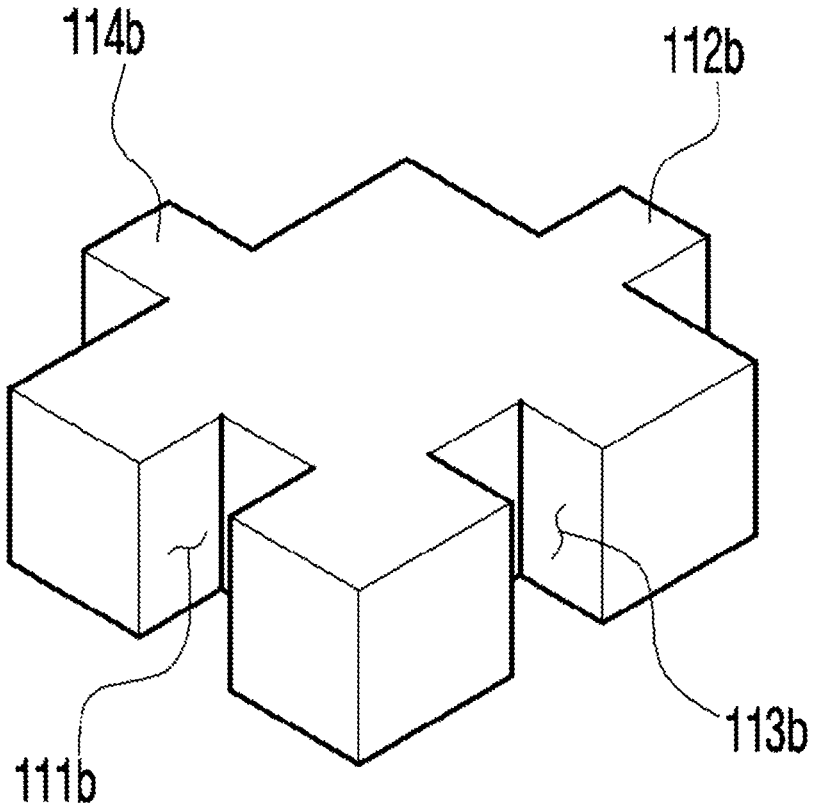
FIG. 11 is a cross-sectional view for explaining a body portion of FIG. 10.

FIG. 10 is a partially exploded perspective view illustrating a golf practice apparatus 1*b* according to another embodiment of the present disclosure, and FIG. 11 is a cross-sectional view illustrating a body portion 100*b* of FIG. 10. For convenience of explanation, descriptions of the same configurations as those described with reference to FIGS. 1 to 9 are omitted or briefly provided.

Referring to FIGS. 10 and 11, a golf practice apparatus 1*b* according to another embodiment may include a body portion and a lifting/lowering portion 210*b*.

The body portion may have a different structure from those of the body portion 100 and body portion described in FIGS. 1 to 9. The body portion may include a plurality of bodies 110*b* respectively corresponding to lifting/lowering units 210*b* and arranged in a plurality of columns and rows. The plurality of bodies 110*b* may respectively correspond to the lifting/lowering units 210*b*. In addition, the bodies 110*b* may respectively correspond to the above-described partitioned areas. Accordingly, in another embodiment, the partitioned areas may be areas physically partitioned by the bodies 110*b*.

The lifting/lowering units 210*b* may move the bodies 110*b* respectively corresponding thereto in a vertical direction.

When any one of the lifting/lowering units 210*b* moves in a downward direction, the bodies 110*b* respectively corresponding to the lifting/lowering units 210*b* moving in the downward direction may move in the downward direction. When any one of the lifting/lowering units 210*b* moves in an upward direction, the bodies 110*b* respectively corresponding to the lifting/lowering units 210*b* moving in the upward direction may move in the upward direction.

The bodies 110*b* may each include a sliding groove 111*b*, a sliding protrusion 112*b*, an additional sliding groove 113*b*, and an additional sliding protrusion 114*b*. The bodies 110*a* may slide in the vertical direction along the sliding grooves 111*a* or the additional sliding grooves 113*b* of the adjacent bodies 110*a*.

When a first body 110*b*-1, which is one of the bodies 110*b*, and a second body 110*b*-2, which is the other one of the bodies 110*b*, are located adjacent to each other, the first body 110*b*-1 may include a sliding groove 111*b*-1 recessed inward on one side adjacent to the second body 110*b*-2, and the second body 110*b*-2 may include a sliding protrusion 112*b*-2 protruding outward on one side adjacent to the first body 110*b*-1 and inserted into the sliding groove 111*b*-1. At this time, the second body 110*b*-2 may slide in the vertical direction along the sliding groove 111*b*-1 of the first body 110*b*-1.

In addition, when the first body 110*b*-1 and a third body 110*b*-3, which is the remaining one of the bodies 110*b*, are located adjacent to each other, the first body 110*b*-1 may include an additional sliding groove 113*b*-1 recessed inward on the other side adjacent to the third body 110*b*-3, and the third body 110*b*-3 may include an additional sliding protrusion 114*b*-3 recessed outward on one side adjacent to the first body 110*b*-1 and inserted into the additional sliding groove 113*b*-1. At this time, the third body 110*b*-3 may slide in the vertical direction along the additional sliding groove 113*b*-1 of the first body 110*b*-1.

The golf practice apparatus 1 of the present disclosure may implement not only a putting green but also the entire field. In addition, the golf practice apparatus 1 may reproduce a state in which a ball is placed, such as a second shot or third shot. Moreover, the golf practice apparatus 1 may implement various shots such as wood, iron, wedge, etc.

The size, shape, form, arrangement, installation interval, etc. of the lifting/lowering units 210 of the present disclosure are not limited to the drawings of the present specification and may have various forms.

In addition, the size of the golf practice apparatus 1 may add or remove the configuration of the body portion 100 and the configuration of the lifting/lowering portion 200 in consideration of a work environment of a user, cost, etc. As partition areas of the body portion 100 are subdivided and the configuration of the lifting/lowering portion 200 is added, the golf practice apparatus 1 may implement a more elaborate field.

In the above, the present disclosure has been described with specific details such as specific components, the limited embodiments and the drawings, but these are only provided to facilitate a more general understanding of the present disclosure, the present disclosure is not limited to the above embodiments, and those skilled in the art may achieve various modifications and changes based on the description.

Therefore, the spirit of the present disclosure should not be limited to the above-described embodiments, and the claims described below as well as all modifications equally to or equivalent to the claims shall fall within the scope of the spirit of the present disclosure.

What is claimed is:

1. A golf practice apparatus comprising:

a body portion comprising a hole-cup hole, into which a golf ball goes, formed at an upper side thereof;

a lifting/lowering portion connected to a lower side of the body portion and configured to move at least a partial area of the body portion in a vertical direction; and a control portion configured to control the lifting/lowering portion by using ground information input through an input portion, wherein the lifting/lowering portion comprises:

a plurality of air cells arranged in a plurality of columns and rows and configured to push or pull the partial area of the body portion; and an air pump configured to inject and remove air into and from each of the air cells, the body portion comprises a plurality of bodies arranged in a plurality of columns and rows to correspond to the air cells, the air cells respectively correspond to the bodies, respectively connected to middle areas of the bodies, and respectively moving the bodies in the vertical direction, the ground information comprises a plurality of pieces of partition information of a ground partitioned based on the plurality of columns and rows of the air cells, each of the plurality of pieces of partition information comprises height information of the partitioned ground, the control portion is configured to control the air cells by using the height information, each of the bodies comprises:

a sliding groove recessed inward;

a sliding protrusion located opposite the sliding groove and protruding outward;

an additional sliding groove located between the sliding groove and the sliding protrusion and recessed inward; and an additional sliding protrusion located opposite to the additional sliding groove and protruding outward, the sliding protrusion of each of the bodies moves in the vertical direction while inserted into an adjacent sliding groove, and the additional sliding protrusion of each of the bodies moves in the vertical direction while inserted into an adjacent additional sliding groove.

2. The golf practice apparatus of claim 1, further comprising the control portion configured to receive ground information of a field and control the air pump so that the body portion corresponds to the ground information.

3. The golf practice apparatus of claim 2, wherein the ground information includes a plurality of pieces of partition information of a partitioned ground so as to correspond to an arrangement of the air cells, and each of the plurality of pieces of partition information includes the height information of the partitioned ground.

4. The golf practice apparatus of claim 3, wherein the control portion is configured to control the air pump so that the air cells are lowered when height values of the air cells are greater than the height information, and control the air pump so that the air cells are lifted when the height values of the air cells are greater than the height information.

* * * * *